US012685389B2

(12) United States Patent
Tramutola

(10) Patent No.: US 12,685,389 B2
(45) Date of Patent: Jul. 21, 2026

(54) WOOD-BURNING TABLE WITH ISOLATED FIRE CONTAINER

(71) Applicant: Christopher A. Tramutola, Greenwich, CT (US)

(72) Inventor: Christopher A. Tramutola, Greenwich, CT (US)

( * ) Notice: Subject to any disclaimer, the term of this patent is extended or adjusted under 35 U.S.C. 154(b) by 0 days.

(21) Appl. No.: 18/800,011

(22) Filed: Aug. 10, 2024

(65) Prior Publication Data

US 2026/0041232 A1 Feb. 12, 2026

(51) Int. Cl.

| | |
|---|---|
| ***A47B 37/04*** | (2006.01) |
| ***F24B 3/00*** | (2006.01) |
| ***F24B 13/00*** | (2006.01) |

(52) U.S. Cl.

CPC ..... *A47B 37/04* (2013.01); *F24B 3/00* (2013.01); *F24B 13/002* (2013.01)

(58) Field of Classification Search

CPC . A47B 37/04; A47B 31/02; F24B 3/00; F24B 13/002

See application file for complete search history.

(56) References Cited

U.S. PATENT DOCUMENTS

| | | | | |
|---|---|---|---|---|
| 4,077,387 | A * | 3/1978 | Bateman | F24B 3/00 126/29 |
| 6,065,466 | A * | 5/2000 | Baykal | A47J 37/0781 126/41 R |
| 10,094,574 | B2 * | 10/2018 | Quigley | A47J 37/00 |
| 10,746,408 | B1 * | 8/2020 | Goin | F24B 5/028 |
| 11,015,818 | B1 * | 5/2021 | Ritchie | F24B 5/026 |
| 11,179,003 | B2 * | 11/2021 | True | F24C 1/00 |
| 11,779,153 | B2 * | 10/2023 | True | A47B 31/02 99/324 |
| 11,846,428 | B1 * | 12/2023 | Cantelar | F24B 3/00 |
| 11,988,388 | B1 * | 5/2024 | Poteet | F24C 3/14 |
| 12,000,593 | B1 * | 6/2024 | Cantelar | F24B 3/00 |
| 12,385,643 | B1 * | 8/2025 | Weilert | F24B 1/195 |
| 2014/0174427 | A1 * | 6/2014 | Yuen | A47J 37/0713 99/449 |
| 2016/0166109 | A1 * | 6/2016 | Banal | A47B 11/00 108/50.13 |
| 2017/0030584 | A1 * | 2/2017 | Mueller | A47B 37/04 |
| 2020/0178729 | A1 * | 6/2020 | Ritchie | F24B 1/028 |

(Continued)

*Primary Examiner* — Daniel J Rohrhoff

(74) *Attorney, Agent, or Firm* — BECKMAN LAW P.C.; Christopher Beckman

(57) ABSTRACT

New forms of fire-containing furniture, and methods for their use, are provided. In some embodiments, a fire-containing table, including a fire-holding platform, suspended vertically below the top of the table, is provided. The fire-holding platform includes a fire container, and may include a plurality of gaps between the fire container and the table top. A first air gap may be provided horizontally, between the fire container and a cut-out in the table top, and a second air gap may be provided, vertically, between the fire-holding platform and the table top. An intermediate fire base may be included, creating a third air gap. In some embodiments, a height-adjustable fire shield surrounding the fire container is switched between a lowered and raised position, sealing and opening the fire container. The fire shield may be force-biased, creating a peripheral fire wall on the table top, and opening lower air vents when raised.

20 Claims, 14 Drawing Sheets

(56) References Cited

U.S. PATENT DOCUMENTS

| | | | | |
|---|---|---|---|---|
| 2021/0018180 | A1* | 1/2021 | Jan | F24B 1/192 |
| 2021/0048188 | A1* | 2/2021 | Harrington | F23B 20/00 |
| 2024/0260745 | A1* | 8/2024 | Westerfield | A47B 33/00 |
| 2025/0093036 | A1* | 3/2025 | Weilert | F24C 15/36 |
| 2025/0283606 | A1* | 9/2025 | Yu | F24B 1/192 |

* cited by examiner

WOOD-BURNING TABLE WITH ISOLATED FIRE CONTAINER

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. Unless otherwise stated, all trademarks and trade dress disclosed in this patent document and other distinctive names, emblems, and designs associated with product or service descriptions, are subject to trademark rights. The trademark and trade dress owner also reserves all trademark rights whatsoever.

FIELD OF THE INVENTION

The present disclosures relate to new forms of furniture including fire features and, more specifically, to patio and other outdoor tables having a built-in fire feature

BACKGROUND

Early man developed fire pits hundreds of thousands of years ago, independently, across many different cultures, as a means to better prepare food and keep warm. Fire-containing devices, such as chimeneas, fire tables and other gas-fired furniture were developed far more recently, and have been rising in popularity. Even to this day, however, most outdoor recreational fires are staged in or on the Earth, due to several well-known complications with fire containing devices.

In each case, these devices pose several serious dangers to their users and other fire builders, and surrounding communities and ecosystems alike.

Fire-containing outdoor chimeneas, which are tall, pot-bellied, freestanding chimneys with a windowed chamber at the base for building fires, are made from bulky, heavy, flame-retardant ceramics. The wood burning chimenea is characterized by having a small and often single directional opening creating a safe configuration and while the ceramic can get very hot, accidental direct access to the flames is mostly prevented. The chimenea does not provide any additional function while actively being used to host a fire or while inactive.

Generally speaking, larger chimeneas are associated with increased safety. If a chimenea is made lighter and/or thinner, it is more likely to fracture and release flames, which can injure bystanders and/or release heat in undesirable directions. On the other hand, chimineas are extremely heavy, bulky, and inconvenient to move.

Tables including a fire feature are also currently available on the market, and have been popular over at least the last 20 years. These are often cylindrically-shaped furniture pieces with central pit areas for typical wood-burning fires. These pieces often have a table function, e.g., for use dining, at least, when not actively burning. The open flame is generally exposed from all sides in these designs.

Some such tables include a gas line, for fueling a fire in the central pit area. Propane or natural gas may be fed into the fire pit through the gas line from a tank, or utility service line, and regulated (e.g., by a valve) and lit by a burner. Often, such a burner is set in a bed of gravel, glass fragments, or lava rock, laying in a recessed area within the table. The burner may include a linear or curvilinear perforated metal tube, which may be ignited by a match, lighter or ignition system. These controlled and often much smaller flames create a balance between safety and functionality of a fire table. While the flame is accessible from all sides, the amount of heat, and arrangement of the flame stays consistent based on burner capacity. Additionally, this improved flame control and drastically reduced quantity of heat preserves the use of the surrounding flat surface as a table while the flame is active. The surrounding users can generally utilize the surrounding ledge/table to place drinks, food, and/or rest their feet without worry.

The design of chimineas and fire tables have remained essentially unchanged for several decades. There is a long-felt need for better outdoor furniture and improvements to fire-displays.

It should be understood that the disclosures in this application related to the background of the invention, in, but not limited to this section titled "Background," do not necessarily set forth prior art or other known aspects exclusively, and may instead include art that was invented concurrently or after the present invention and conception, and details of this application's inventor's own discoveries and work and work results.

SUMMARY OF THE INVENTION

New forms of fire-containing furniture, and methods for their use, are provided. In some embodiments, a fire-containing table, including a fire-holding platform, suspended vertically below the top of the table, is provided. In some such embodiments, the fire-holding platform includes a fire container, and one or more air gap(s) between the fire container and the table top. In some such embodiments, such a fire container is cylindrical. In some such embodiments, such a fire container is at least partially rectilinear. In some embodiments, a first air gap is provided horizontally, between the fire container and a cut-out in the table top, and/or a second air gap is provided, vertically, between the fire-holding platform and the underside of the table top.

Such a fire-holding platform may be so suspended from such a table top, in some embodiments, by periodic members (such as rods, dowels, cables, gratings, bars and/or pins), providing additional air gaps between the table top and the fire-holding platform, as well as between the members themselves. In some embodiments, such rods, dowels, cables, gratings bars and/or pins are at least generally vertically-oriented and/or vertically-aligned. And, in some embodiments, such rods, dowels, cables, gratings, bars and/or pins are uniform in size (e.g., having a uniform height and/or width). In some embodiments, such additional air gaps are also uniform in size (e.g., having a uniform height and/or width). In some embodiments, the rods, dowels, cables, gratings, bars and/or pins are fire-resistant and/or fire-proof. In any of the above embodiments, such rods, dowels, cables, gratings, bars and/or pins, along with air gaps presented between them, serve as a thermal break, preventing the conduction of heat. And, in some embodiments, such rods, dowels, cables, gratings, bars and/or pins serve as a barrier against accidental (or attempted) interactions with a fire burning on the fire-holding platform and/or fire container.

As discussed above, in some embodiments, such a fire container is cylindrical. And, in some embodiments, such a fire container is rectilinear, or, at least partially rectilinear. In various embodiments, the fire container may be any of a number of standard, symmetrical, or asymmetric shapes appropriate for holding a fire.

In some such embodiments, such a fire container is provided within and/or underneath a cut-out in the tabletop. Even when the fire container is provided within such a cut-out of the table top, it may, nonetheless, be provided within a lateral (horizontal) air gap, between an upper edge or lip of the fire container, and a side edge(s) of the cut-out. In some embodiments, the cut-out and the fire container may be complementary in shape, creating an air gap with a uniform width between them (i.e., between the upper edge of the fire container and the side edge of the cut-out). For example, in some embodiments, a cylindrical fire container and a circular tabletop cut-out (larger and complementary to the circular upper edge of the fire container) are provided, and a uniform, ring-shaped horizontal air gap may be provided between the side edge(s) and the upper edge or lip of the fire container. Thus, as discussed above, in some such embodiments, the fire container and table top are separated by a first, horizontal air gap, providing a first thermal break between the table top and the fire container. Generally speaking, the cut-out in the table top allows for flames and hot gasses to be displayed, rising out of, and above the table, as well as permitting the fire to breathe and expel gases upward. In some embodiments, the cut-out in the table serves as a form of chimney, and may include vertically-oriented wall(s) extending upward from the tabletop, and defining a flue area within it. In some embodiments, the cut-out is centered in the table top, and/or held within a minimum safe margin from a human-reachable area (or area that is likely to be reached) or outer edge of the table top. In some embodiments, the minimum safe margin is determined based on a maximum permitted temperature at or about all regions of the table top that may be accessed by a majority of users, based on a maximum permitted wood fire size to be built on the fire-holding platform, and based on the size, shape and thermal properties of the table top, as well as the distance of touchable areas of the table top from the maximum permitted wood fire size.

In some embodiments, such a fire container includes a removable and replaceable heat-resistant, heat-proof and/or flame-resistant cover (a "heat-proof cover"). In various embodiments, such a heat-proof cover may be constructed from any suitable heat-resistant, heat-proof and/or flame-resistant material known in the art, such as granite, stainless steel, nickel and nickel-based alloys, ceramics, glass, quartz, KEVLAR and/or other flame-resistant aramids. In some embodiments, the heat-proof cover includes an insulator (e.g., lining an underside that interfaces with an upper edge of the fire container), providing a thermal break between the upper edge of the fire container and/or cut-out and the top of the heat-proof cover. And, in some embodiments, the heat-proof cover includes an air-tight seal (e.g., lining an underside that interfaces with the upper edge of the fire container) which may be attached to, integral with and/or included within such an insulator, in some such embodiments. In some embodiments, the heat-proof cover is placed above, and covers (e.g., entirely) the cut-out in the table top. However, in some embodiments, the cut-out, or another abutting structure of the table top, includes a complimentary notch(es) or lip(s), which hold the upper surface of the heat-proof cover flush with the upper surface of the table top, as will be shown and explained in greater detail below. In some embodiments, upon extinguishing a fire built on the fire-holding platform, a user may replace the heat-proof cover, and immediately place drinks, food and other objects safely on the heat-proof cover.

As mentioned above, in some embodiments, the heat-proof cover interfaces with an upper edge of the fire container. In some such embodiments, the heat-proof cover interfaces with a height-adjustable fire shield, surrounding the fire container, and, in some such embodiments, the height-adjustable fire shield is shiftable, between at least two vertical positions: 1. a raised position, in which the height-adjustable fire shield is raised above the vertical position of the table top, forming a ring structure, emerging from within the table top cut-out; and 2. a lowered position, in which the height-adjustable fire shield is lowered below, or at least approximately even with, or more even with, the table top. In the raised position, in some embodiments, the ring structure emerging from within the table top cut-out includes a flame-proof or flame-resistant wall, e.g., serving as a fireguard. But, in the lowered position, the flame-proof or flame-resistant wall (and fireguard) is no longer deployed above the table top. In some embodiments, the ring structure, and flame-proof or flame-resistant wall, may be locked in place, either in the raised and/or lowered position (e.g., by a catch, lock and/or switch mechanism).

In some such embodiments, the height-adjustable fire shield may be spring-loaded, tending to cause the height-adjustable fire shield to rise to the raised position. And, as also mentioned above, in some such embodiments, the heat-proof cover may be placed on, thereby interfacing with, the upper edge of the fire container and the height-adjustable fire shield (e.g., via a complementary circumferential lip and/or notch). When so placed, in some such embodiments, the weight of the heat-proof cover may overcome the upward force of the spring-loading, causing the height-adjustable fire shield to descend into the lowered position, as discussed above.

In some embodiments, the height-adjustable fire shield surrounds, and is complementary in shape to, a main wall(s) of the fire container, which is fixed to (and not shiftable relative to) the fire platform, in some such embodiments. Thus, in such embodiments, the height-adjustable fire shield is shiftable relative to the main wall(s) of the fire container. In some embodiments, the main wall(s) of the fire container include one or more air vents, at or about the bottom of the fire container. In some such embodiments, the one or more air vents is provided on or about a lower area of the main wall(s). In some embodiments, the one or more air vents is covered by the height-adjustable fire shield, when the height-adjustable fire shield is shifted into the lowered position. And, in some such embodiments, the one or more air vents is tightly so covered (creating an at least approximately airtight seal). Because, as discussed above, in some embodiments, when placed on the upper edge of the fire container and height-adjustable fire shield, the heat-proof cover has an air-tight seal with the upper edge of the fire container, and, simultaneously, causes the height-adjustable fire shield to descend and tightly cover the air vents, the single act of so placing the heat-proof cover deprives the fire container of all airflow from the exterior of the fire container. As a result, a fire burning within the fire container will then be deprived of a source of oxygen, and be extinguished, through that single act.

In some embodiments, a raised, intermediate fire base is included as part of fire-holding platform. In some such embodiments, such an intermediate fire base may be suspended above a bottom panel of the fire-holding platform by heat-proof and/or insulating spacers, which, in some such embodiments, are fastened to the bottom panel. In various embodiments, heat-proof and/or insulating spacers are in the form of threaded rods, dowels, gratings, bars and/or pins or any other suitable form of spacer known in the art, and may be fastened to spacer pin holes. As will be discussed in greater detail below, in some embodiments, such spacers aid in creating an additional vertical insulation layer and/or air gap, between the intermediate fire base and the bottom panel.

Canons of Construction

Where any term having multiple possible meanings, based on a reasonable interpretation, is set forth in a sentence, clause or other statement (a "statement") in this application, this application should be read as if each such reasonably possible meaning, significance and/or sense of each and every such term and statement is separately, conjunctively and alternatively set forth in additional alternative statement(s) thereafter.

It should also be understood that, for convenience and readability, this application may set forth particular pronouns and other linguistic qualifiers of various specific gender and number, but, where this occurs, this application should be read as if each other gender and number is separately, conjunctively and alternatively set forth in additional alternative statement(s) thereafter.

The embodiments set forth in detail in this application are to ease the reader's understanding of inventions set forth herein and, as such, are only examples of the virtually innumerable alternative embodiments falling within the scope of the application. No specific embodiment set forth in this application should be read as limiting the scope of any claimed inventions; the inventions of the present application are not limited to any particular preferred embodiment disclosed.

These and other aspects of the invention will be made clearer below, in other parts of this application. This Summary, the Abstract, and other parts of the application, are for ease of understanding only, and no part of this application should be read to limit the scope of the invention, whether or not it references matter also set forth in any other part.

BRIEF DESCRIPTION OF THE DRAWINGS

The features and advantages of example embodiments of the invention presented herein will become more apparent from the detailed description set forth below when taken in conjunction with the following drawings.

DETAILED DESCRIPTION OF THE INVENTION

Figure 1:
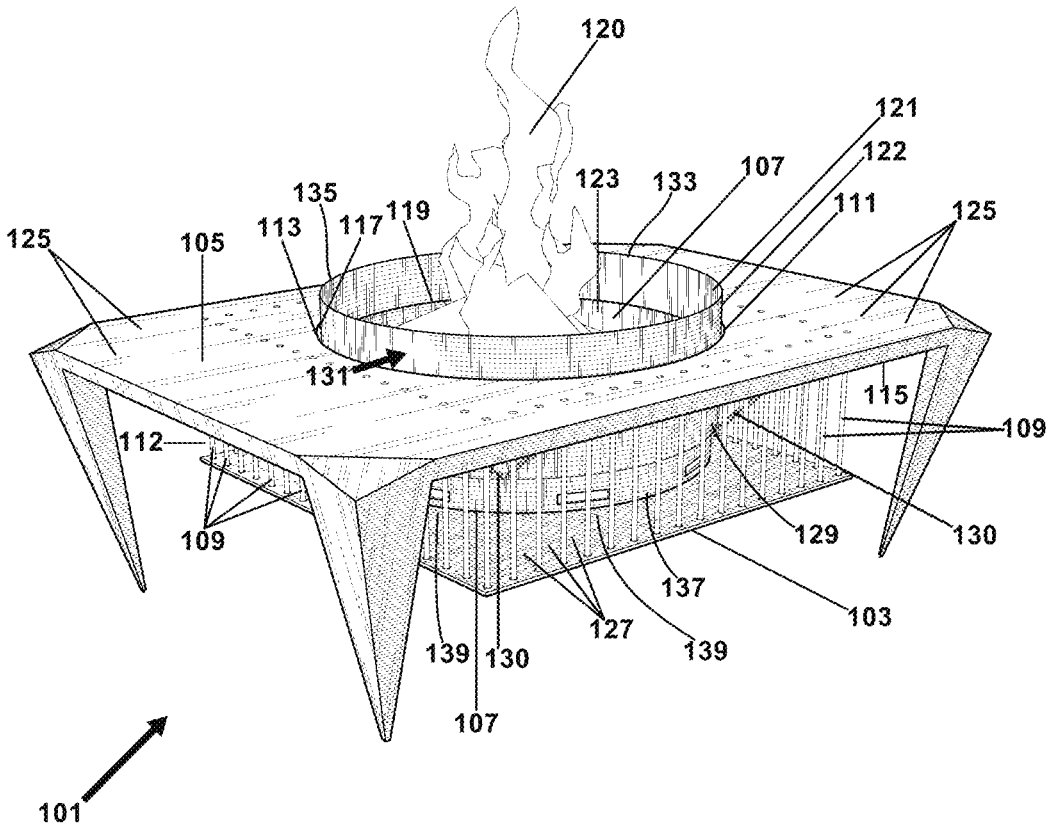
FIG. 1 is a three-quarter perspective drawing of an example fire-containing table, in accordance with some embodiments of the present application.

The features and advantages of example embodiments of the invention presented herein are directed to new forms of fire-containing furniture, and methods for their use, which are now described herein. These and other aspects will become more apparent from the detailed description set forth below when taken in conjunction with the drawings. This description is not intended to limit the application to the embodiments presented herein, which are only examples of the virtually unlimited possible embodiments falling within the scope of the present application. In fact, after reading the following description, it will be apparent to one skilled in the relevant art(s) how to implement the following example embodiments in alternative embodiments, including any possible order, number or other arrangement of components and subcomponents (the following orders, components, subcomponents and/or relationships being non-limiting).

Embodiments of fire-containing furniture, and methods for their use in accordance with some aspects set forth in this Specification are depicted in FIGS. 1 through 14. The following is a list of defined components and/or aspects and reference numbers therefor, as used throughout the figures:

| Reference No. | Component |
|---|---|
| 101 | fire-containing table |
| 103 | fire-holding platform |
| 105 | table top |
| 107 | fire container |
| 109 | platform-suspending pins |
| 111 | first, horizontal air gap |
| 112 | second air gap (vertical) |
| 113 | cut-out (in table top 105) |
| 115 | underside (of table top 105) |
| 117 | side edge(s) (of cut-out 113) |
| 119 | upper edge (of fire container 107) |
| 120 | flames |
| 121 | chimney |
| 122 | vertically-oriented wall(s) (of chimney 121) |
| 123 | flue area |
| 125 | human-reachable areas |
| 127 | interstitial air gaps |
| 129 | height-adjustable fire shield (surrounding fire container 107) |
| 130 | coil springs |
| 131 | raised position (of height-adjustable fire shield 129) |
| 133 | ring structure |
| 135 | flame-proof or flame-resistant rising wall |
| 137 | main wall(s) (of fire container 107) |
| 139 | air vents |
| 141 | bottom (of fire container 107) |
| 201 | heat-proof cover |
| 203 | upper surface (of heat-proof cover 201) |
| 205 | flush configuration (of upper surface 203 with table top) |
| 207 | lowered position (of outer height-adjustable fire shield 129) |
| 301 | open top (of fire container 107) |
| 303 | lower edges (of fire container 107) |
| 401 | main frame component |
| 403 | legs |
| 405 | minimized footprint |
| 407 | downward-facing points |
| 409 | pin holes |
| 501 | empty pin holes |
| 503 | filled condition (of pin holes 409) |
| 505 | filled pin holes |
| 507 | fastened pin |
| 509 | fastener heads |
| 601 | fuel |
| 603 | logs and/or sticks of wood |
| 701 | bottom panel (of fire-holding platform 103) |
| 703 | removable fasteners |
| 705 | lower pin holes |
| 707 | spacers |
| 709 | spacer pin holes |
| 711 | exposed edges (of sheet material) |
| 801 | lower surface (of heat-proof cover 201) |
| 803 | natural stone |
| 805 | marble pattern |
| 1001 | contracted condition (of coil springs 130) |
| 1003 | bottom edge (of height-adjustable fire shield 129) |
| 1005 | bottom side (of table top 105) |
| 1007 | raised, intermediate fire base |
| 1009 | spacer rods |
| 1011 | additional vertical insulation layer and/or air gap |
| 1301 | air-tight seal(s) |

FIG. 1 is a three-quarter perspective drawing of an example fire-containing table 101, in accordance with some embodiments of the present application. As pictured, in some embodiments, such a fire containing table includes a fire-holding platform 103, which may be suspended, vertically, below a table top 105 of fire-containing table 101. And, provided on, and/or integral with, fire-holding platform 103, a fire container 107 is shown. In some embodiments, fire container 107 is cylindrical, as pictured. However, in some alternative embodiments, such a fire container is at least partially rectilinear, or any other suitable three-dimensional shape for containing a fire, as may be known to those of ordinary skill in the art.

In some embodiments, the fire-holding platform 103 and fire container 107, attached and/or integral therewith, are each suspended from table top 105 by periodic members, such as example platform-suspending pins 109. In some such embodiments, such platform-suspending pins 109 are at least generally vertically-oriented and/or vertically-aligned, as pictured. And, in some embodiments, platform-suspending pins 109 are uniform in size, or substantially uniform in size (e.g., having a uniform, or substantially uniform, height and/or width). In some such embodiments, such periodic members and/or puns may be threaded, allowing the use of threaded female connectors to fasten them to other components of the fire-containing table (e.g., table top 105). The number, frequency and arrangement of such members and/or pins may vary widely in different embodiments of the invention, the embodiments specifically set forth and pictured in this application being only exemplary of the virtually unlimited numbers, frequencies and arrangements of such members falling within the scope of the inventions set forth herein.

Because fire-holding platform 103 is so suspended from table top 105 with a series of periodic members, a number of air gaps and thermal breaks are provided. For example, at least one first, horizontal air gap 111 is provided between the fire container 107 and a cut-out 113 in the table top 105, and/or a second air gap 112 is provided, vertically, between the fire-holding platform 103 and the underside 115 of the table top 105, in some embodiments. Such a first, horizontal air gap 111 provides a first thermal break between the table top 105 and the fire container 107. And, the second air gap 112 provides a second thermal break, between the fire-holding platform 103 and the remainder of the fire-containing table 101, in some embodiments. The first, horizontal air gap 111, is provided between an upper edge 119 of the fire container 107, and side edge(s) 117 of the cut-out 113. In some embodiments, the cut-out 113 and the fire container 107 may be complementary in shape, creating a horizontal air gap 111 with a uniform width between them (i.e., between the upper edge 119 of the fire container 107 and the side edge(s) 117 of the cut-out 113). For example, in some embodiments, a cylindrical fire container 107 and a circular tabletop cut-out 113 (larger and complementary to the circular upper edge 119 of the fire container 107) are provided, and horizontal air gap 111 may be uniform and ring-shaped, as provided between the side edge 117 of cut-out 113 and the upper edge 119 of the fire container. It should be noted that, in some embodiments, a plurality of horizontal air gaps are provided between the fire container 107 and the cut-out 113. For example, as pictured, two horizontal air gaps 112, are provided, including an outer horizontal air gap 114 and an inner horizontal air gap 116, which are divided by a height-adjustable fire shield, discussed in further detail below.

Generally speaking, the cut-out 113 in the table top 105 allows for flames and hot gasses to be displayed, such as example flames 120, shown rising out of, and above the fire-containing table 101, as well as permitting the fire to breathe and expel gases upward. In some embodiments, the cut-out 113 in the table serves as a form of chimney 121, and may include vertically-oriented wall(s) 122, extending upward from the tabletop 105, and defining a flue area 123, within it. In some embodiments, the cut-out 113 is centered in the table top, and/or held within a minimum safe margin from a human-reachable area (or area that is likely to be reached) or outer edge of the table top, such as the example human-reachable areas 125, as shown. In some embodiments, the minimum safe margin is determined based on a maximum permitted temperature at or about all regions of the table top that may be accessed by a majority of users, based on a maximum permitted wood fire size to be built on the fire-holding platform 103, and based on the size, shape and thermal properties of the table top, as well as the distance of touchable areas of the table top from the maximum permitted wood fire size.

However, although the example of platform-suspending pins has been provided, it should be understood that any suitable form of thin, periodically placed members, such as rods, dowels, cables, gratings, bars and/or pins, may be, alternatively or in addition, be provided as such periodic members. In any event, it should also be noted that the members, in whatever form, may be uniform in size (e.g., having a uniform height and/or width), in some embodiments. As such, in some such embodiments, additional air gaps, between the members, may also be provided, such as the example air gaps shown as interstitial air gaps 127. In some embodiments, such additional air gaps are also uniform in size (e.g., having a uniform height and/or width), as pictured for interstitial air gaps 127. In some embodiments, the members are fire-resistant and/or fire-proof. In any of the above embodiments, the members, along with air gaps presented between them, serve as a thermal break, preventing and/or reducing the conduction of heat. And, in some embodiments, such members serve as a barrier against accidental (or attempted) interactions with a fire burning on the fire-holding platform and/or fire container.

In various embodiments, the periodic members may comprise any suitable heat-proof, heat-resistant, flame-proof, flame-resistant and/or insulating materials, as known in the art. In some embodiments, such periodic members comprise a metal, such as brass, nickel and/or iron, or other metals or alloys. In some embodiments, the periodic members may comprise a plastic or wood, as in the instance of wooden dowels or pegs.

Figure 2:
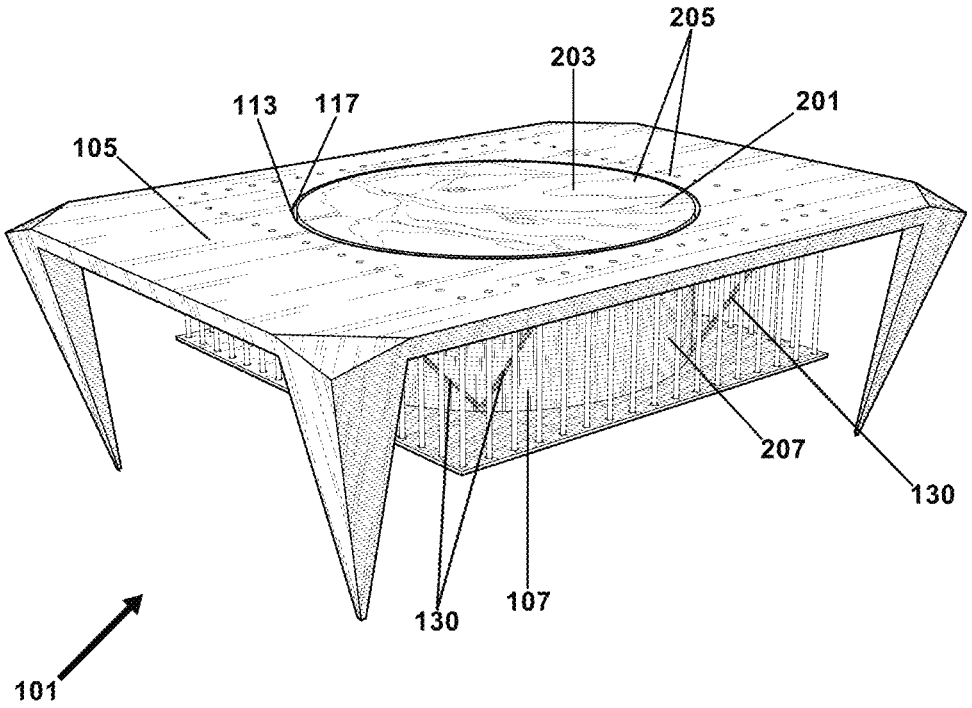
FIG. 2 is a three-quarter perspective drawing of the same example fire-containing table discussed above, in reference to FIG. 1, along with a heat proof cover placed over a cut-out in the table top and fire container of the fire-containing table, in accordance with some embodiments of the present application.

In some embodiments, the upper edge 119 of the fire container 107 is surrounded, at least in part, by a height-adjustable fire shield 129, and, in some such embodiments, the height-adjustable fire shield 129 is shiftable, between at least two vertical positions: 1) a raised position 131, in which the fire shield 129 is raised above the vertical position of the table top, forming a ring structure 133, emerging from within the table top 105 cut-out 113 (as pictured); and 2) a lowered position, in which the fire shield 129 is lowered below, or at least approximately even with, or more even with, the table top (not pictured in the present figure, but shown as lowered position 207, in FIG. 2). In the raised position 131, in some embodiments, the ring structure 133 emerging from within the table top 105 cut-out 113 includes a flame-proof or flame-resistant rising wall 135, e.g., serving as a fireguard, deflecting and holding in flames. But, in the lowered position, the flame-proof or flame-resistant rising wall 135 (and fireguard) is no longer deployed above the table top 105. In some embodiments, the ring structure, and flame-proof or flame-resistant rising wall 135, may be locked in place, either in the raised and/or lowered position (e.g., by a catch, lock and/or switch mechanism).

In some such embodiments, the height-adjustable fire shield 129 may be spring-loaded (e.g., by example coil springs 130, in some embodiments), tending to cause the fire shield 129 to rise to the raised position 131, as pictured. And, in some such embodiments, a heat-proof cover (not pictured in the present figure) may be placed on, and interfaces with the upper edge 119 of the fire container 107 and height-adjustable fire shield 129 (e.g., via a complementary circumferential lip and/or notch). When so placed, in some such embodiments, the weight of the heat-proof cover may overcome the upward force of the spring-loading, causing the height-adjustable fire shield 129 to descend into the lowered position, as will be discussed further, below.

In some embodiments, the height-adjustable fire shield 129 surrounds, and is complementary in shape to, a main wall(s) 137 of the fire container 107, which is fixed to (and not shiftable relative to) the fire-holding platform 103, in some such embodiments. Thus, in such embodiments, the height-adjustable fire shield 129 is shiftable relative to the main wall(s) 137 of the fire container 107. In some embodiments, the main wall(s) 137 of the fire container 107 include one or more air vents, such as the examples shown as air vents 139, at or about the bottom 141 of the fire container 107. In some such embodiments, the one or more air vents 139 is/are provided on or about a lower area of the main wall(s) 137. In some embodiments, the one or more air vents 139 is/are covered by the height-adjustable fire shield 129, when the height-adjustable fire shield 129 is shifted into the lowered position. And, in some such embodiments, the one or more air vents 139 is/are tightly so covered (creating an at least approximately airtight seal). Because, as discussed above, in some embodiments, when placed on the upper edge of the fire container and height-adjustable fire shield 129, the heat-proof cover has an air-tight seal with the upper edge 119 of the fire container, and, simultaneously, causes the height-adjustable fire shield 129 to descend and tightly cover the air vents 139, the single act of so placing the heat-proof cover deprives the fire container 107 of all airflow from the exterior of the fire container. As a result, a fire burning within the fire container will then be deprived of a source of oxygen, and be extinguished, through that single act.

FIG. 2 is a three-quarter perspective drawing of the same example fire-containing table 101 discussed above, in reference to FIG. 1, along with a heat-proof cover 201 placed over the cut-out 113 in the table top 105 and fire container 107 of the fire-containing table 101, in accordance with some embodiments of the present application. As discussed above, in some embodiments, fire container 107 includes a removable and replaceable, heat-resistant, heat-proof and/or flame-resistant cover, such as the example shown as heat-proof cover 201. In various embodiments, such a heat-proof cover may be constructed from any suitable heat-resistant, heat-proof and/or flame-resistant material known in the art, such as granite, stainless steel, nickel and nickel-based alloys, ceramics, glass, quartz, KEVLAR and/or other flame-resistant aramids. In some embodiments, the heat-proof cover includes an insulator (e.g., lining an underside that interfaces with an upper edge of the fire container), providing a thermal break between the upper edge of the fire container and/or cut-out and the top of the heat-proof cover. And, in some embodiments, the heat-proof cover includes an air-tight seal (e.g., lining an underside that interfaces with the upper edge of the fire container) which may be attached to, integral with and/or included within such an insulator, in some such embodiments.

In some embodiments, the heat-proof cover may be placed above and cover (e.g., entirely) the cut-out 113 in the table top 105. However, in some embodiments, the cut-out 113, or another abutting structure of the table top 105, includes a complimentary notch(es) or lip(s) (not visible in the present figure, but attached to or integral with side edge(s) 117 of the cut-out 113, in some such embodiments), which hold a lower surface (not visible) of the heat-proof cover, and, resultingly, position an upper surface 203 of the heat-proof cover 201 in a flush configuration 205 with the upper surface of the table top, as shown. In some embodiments, upon extinguishing a fire built on the fire-holding platform, a user may replace the heat-proof cover, and immediately place drinks, food and other objects safely on the heat-proof cover, on upper surface 203. As mentioned above, in some embodiments, the heat-proof cover interfaces with an upper edge of the fire container. (Not visible in the present figure.)

In order to place heat-proof cover 201 over cut-out 113 in table top 105 and fire container 107, in such a flush configuration, heat-proof cover 201 first had to be placed over upper edge 119 (not visible in the present figure) of the fire container 107, and the upper edge of height-adjustable fire shield 129. And, as a result of the weight of heat-proof-cover (and/or, in some embodiments, downward force from another source, such as a user's arms) being applied downward onto upper edge 119 and height-adjustable fire shield 129, height-adjustable fire shield 129 has been shifted downward, into a lowered position 207, as pictured. As discussed above, when so placed, in some such embodiments, the weight of the heat-proof cover 201 may overcome the upward force of the spring-loading, causing the height-adjustable fire shield 129 to descend into the lowered position 207. In other embodiments the height-adjustable fire shield 129 may be lowered into a mechanism that locks it in place.

And, as a result, height-adjustable fire shield 129 now covers air vents 139, on or about a lower area of the main wall(s) 137. As discussed above, in some embodiments, the one or more air vents 139 is/are covered by the height-adjustable fire shield 129, when the height-adjustable fire shield 129 is shifted into the lowered position 207, as now pictured. And, in some such embodiments, the one or more air vents 139 is/are tightly so covered (creating an at least approximately airtight seal). Because, as discussed above, in some embodiments, when placed on the upper edge of the fire container and height-adjustable fire shield 129, the heat-proof cover has an air-tight seal with the upper edge 119 of the fire container, and, simultaneously, causes the height-adjustable fire shield 129 to descend and tightly cover the air vents 139, the single act of so placing the heat-proof cover deprives the fire container 107 of all airflow from the exterior of the fire container. As a result, a fire burning within the fire container will then be deprived of a source of oxygen, and be extinguished, through that single act.

It should also be noted that, with height-adjustable fire shield 129 in the lowered position 207, the flame-proof or flame-resistant rising wall 135 (not visible in the present figure) is no longer deployed above the table top 105. And, as discussed above, in some embodiments, the ring structure, and flame-proof or flame-resistant rising wall 135, may be locked in place, either in the raised and/or lowered position (e.g., by a catch, lock and/or switch mechanism) (not pictured).

Figure 3:
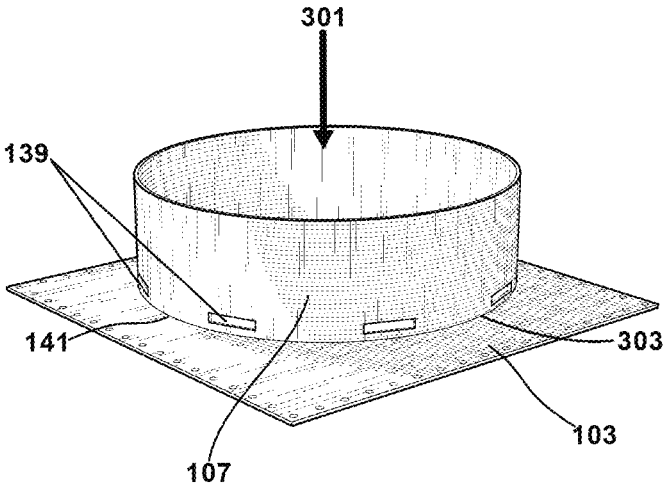
FIG. 3 is a three-quarter perspective drawing of the example fire-holding platform and fire container of the example fire-containing table set forth above, in FIGS. 1 and 2, in accordance with some embodiments of the present invention.

FIG. 3 is a three-quarter perspective drawing of the example fire-holding platform 103 and fire container 107 of the example fire-containing table 101 set forth above, in FIGS. 1 and 2, in accordance with some embodiments of the present invention. As shown in the present figure, fire container 107 is generally cylindrical, in some embodiments, but having an open top 301. In some embodiments, the bottom 141 of fire container 107 is closed, or, at least, partially closed. In some embodiments, fire-holding platform 103 forms the bottom 141 of fire container 107, e.g., by being welded or fused to a lower edge(s) 303 of fire container 107, in some such embodiments. However, in some embodiments, fire container 107 includes an additional closure material, such as an additional sheet of material, abutting, attached to or integral with lower edge(s) 303. Although, in some embodiments, fire container 107 is cylindrical, as pictured, in some embodiments, fire container 107 is at least partially rectilinear, or any other suitable three-dimensional shape for containing a fire, as may be known to those of ordinary skill in the art.

In some embodiments, fire-holding platform 103 and/or fire container 107 are constructed, and/or lined, with fire-proof material(s), which may include any known fire-proof material, including, but not limited to, a wide array of metals and alloys suitable for containing fire, for example. Ceramics, brick, stone and other fire-proof, insulating materials may be included in fire-holding platform 103 and/or fire container 107, in some embodiments. Any other components of fire-containing table 101 may be constructed, and/or lined, with fire-proof materials as well, such as any of the materials discussed above, in some embodiments, which generally are preferred. However, in some embodiments, at least some other components (other than fire-holding platform 103 and/or fire container 107) may be constructed from other materials, which are not as fire-proof, such as wood and/or polymers. This is possible due to the thermal breaks, insulation and suspension of fire-holding platform 103 and/or fire container 107, as discussed above, in accordance with some embodiments. As discussed above, in some embodiments, the fire-holding platform 103 and fire container 107, attached and/or integral therewith, are each suspended from table top 105 by periodic members, such as example platform-suspending pins 109, discussed above (not pictured in the present figure).

Also included in fire container 107 are one or more air vents, such as the examples shown as air vents 139, which, in some embodiments, are located on or about the bottom 141 of fire container 107. Because a fire may be built at or about the bottom 141 of fire container 107, airflow providing oxygen for the fire will then be established, due to rising hot gasses which escape from the open top 301, which create a vacuum pulling new air into fire container 107, flowing from outside of fire container 107, through air vents 139, which maintains the fire as long as suitable fresh fuel (e.g., wood) is continuously provided inside the fire container. Conversely, if the one or more air vents 139, and open top 301, is/are covered by the height-adjustable fire shield 129 (not pictured in the present figure), for example, when the height-adjustable fire shield 129 is shifted into the lowered position 207, discussed above, the fire will be deprived of fresh oxygen and automatically extinguished.

Figure 4:
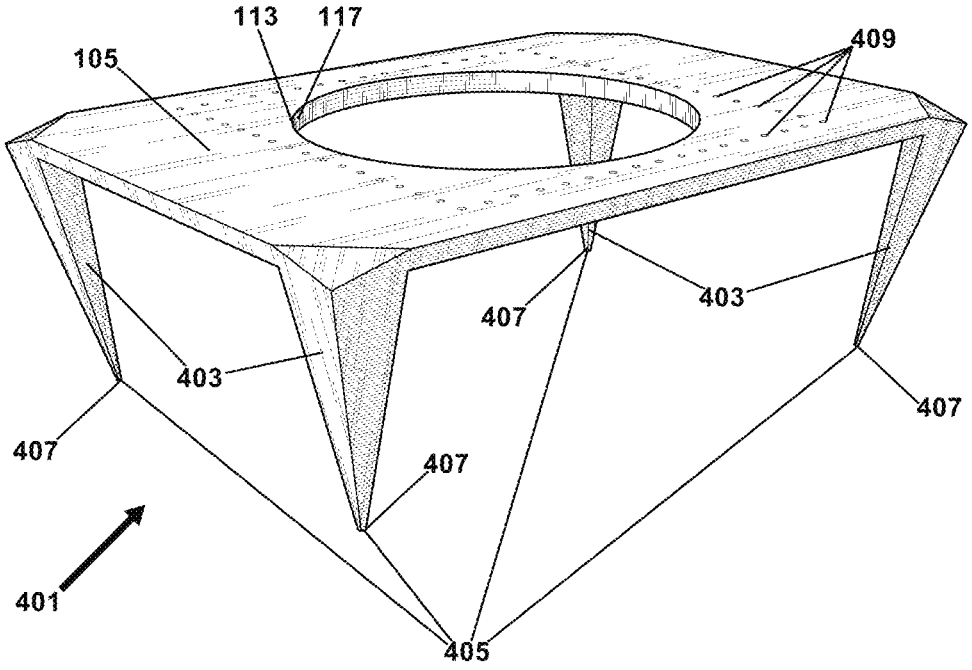
FIG. 4 is a three-quarter perspective drawing of the example main frame component of the example fire-containing table set forth above, in FIGS. 1 and 2, in accordance with some embodiments of the present invention.

FIG. 4 is a three-quarter perspective drawing of the example main frame component 401 of the example fire-containing table 101 set forth above, in FIGS. 1 and 2, in accordance with some embodiments of the present invention. Main frame component 401 includes several components, some of which are related to traditional components for tables and other (e.g., outdoor) furniture, such as table top 105, discussed above, and legs 403, providing support for fire-containing table 101.

However, main frame component 401 also includes several unconventional aspects. For example, in some embodiments, main frame component 401 includes a minimized footprint 405, created by downward-facing points 407, in some embodiments. As used in the present application, the "footprint" of a piece of furniture, such as fire-containing table 101, means the ground or floor area contacted and/or occupied by the piece of furniture when placed on a ground or a floor. For example, in some embodiments, downward-facing points 407 of legs 403 contact and occupy a more limited floor area in comparison with a traditional table, relating to a minimized footprint 405 of fire-containing table 101. Such a minimized footprint may minimize heat transfer from fire-containing table 101 to a floor or ground on which it is placed, in some embodiments.

As another example, and as discussed above, cut-out 113 is provided, in table top 105. In the embodiment pictured, cut-out 113 is circular, and centered, or at least approximately circular and/or approximately centered, in table top 105, in some embodiments. As discussed above, although not visible in the present figure, this circular shape is complementary, and creates a horizontal air gap 111, with a uniform width, between the upper edge 119 of the cylindrical fire container 107 and side edge(s) 117 of cut-out 113. However, as also discussed above, the example of a circular cut-out 113 and a cylindrical fire container 107, are only one possible embodiment, among a virtually unlimited number of possible symmetrical pairings of cut-outs and fire container shapes that may be used to implement aspects of the inventions set forth in this application, as will be apparent to those of skill in the art.

Also, in some embodiments, main frame component 401 includes mounting holes or mounting points, such as the example pin holes 409, as pictured. Pin holes 409 serve as mounting points for the example platform-suspending pins 109, discussed above, which suspend fire-holding platform 103 and fire container 107, as also discussed above, in some embodiments. As with the platform-suspending pins 109 generally, pin holes 409 are similarly periodically spaced, in some embodiments. It should be understood, however, as discussed above, that a wide variety of platform-suspending, periodic members, in addition, or as an alternative to platform-suspending pins 109, may be used, in various embodiments, and the example of platform-suspending pins 109 is only one of an unlimited number of examples, as will be readily apparent to those of ordinary skill in the art. Similarly, the example number, shape and uniform, periodic spacing of pin holes 409 is only an example of an unlimited possible numbers and spacings for such members, some of which may not be uniform, and a number of air gaps and thermal breaks resulting therefrom, as will also be apparent to those of skill in the art.

Figure 5:
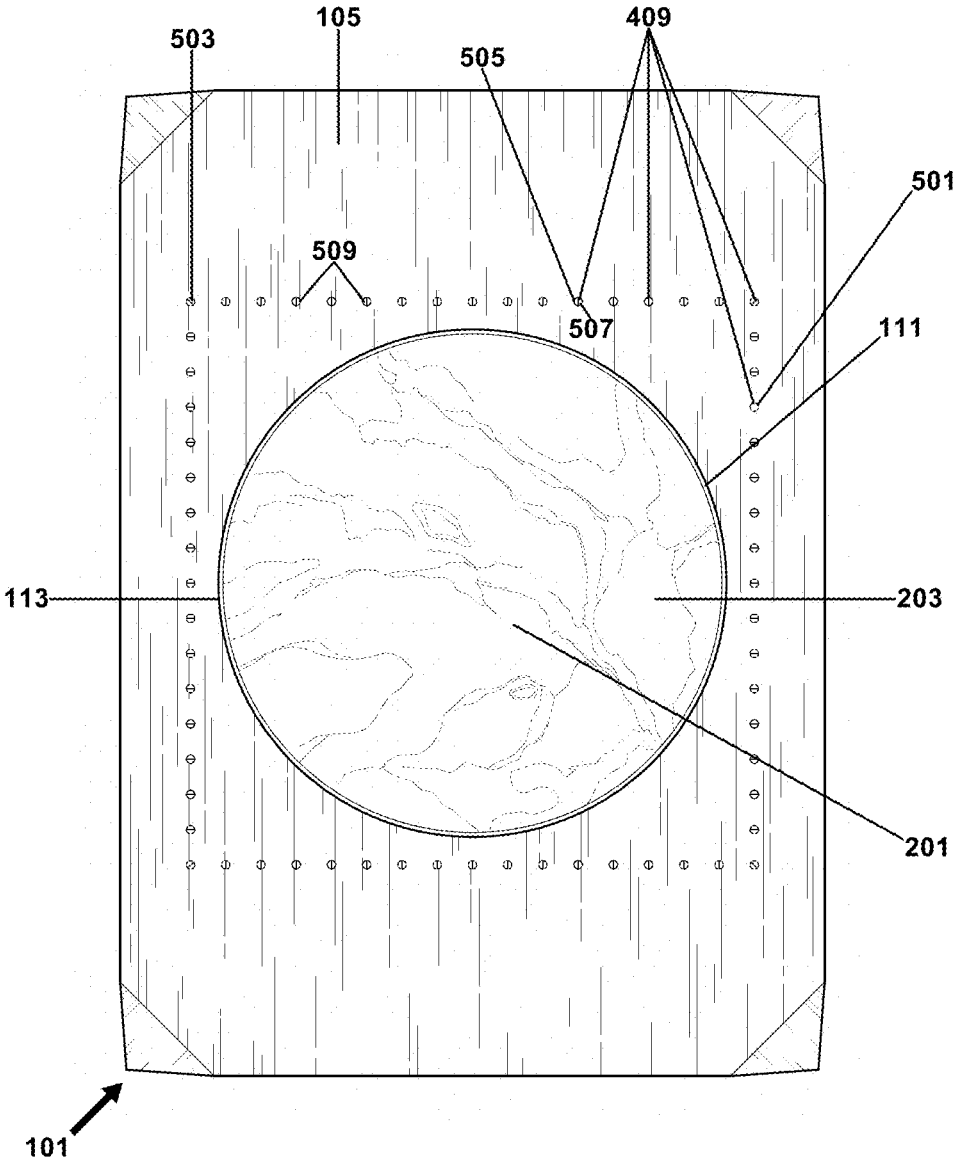
FIG. 5 is a top view drawing of the example fire-containing table set forth above, in FIGS. 1 and 2, with a heat-proof cover placed over a cut-out in the table top and fire container of the fire-containing table, in accordance with some embodiments of the present invention.

FIG. 5 is a top view drawing of the example fire-containing table 101 set forth above, in FIGS. 1 and 2, with a heat-proof cover 201 placed over a cut-out in the table top 105 and fire container of the fire-containing table 101, in accordance with some embodiments of the present invention. From the viewing angle of the figure, aspects of the table top 105, the upper surface 203 heat proof cover 201 and at least part of the horizontal air gap 111, between the fire container 107 and a cut-out 113 in the table top 105, all can be seen. In addition, example pin holes 409 can be viewed, head-on, in two different use conditions: 1. an empty condition, with no pins or members fastened therein, as with example empty pin hole 501, and in 2. a filled condition 503, as with example filled pin hole 505, having a fastened pin 507 fastened therein to table top 105. In the latter, filled condition 503, fastener heads, such as the example flat-head fastener heads 509, appear within the filled pin holes 505, and can be accessed by a fastener driver (not pictured, but, for example, a screwdriver) to secure or loosen them (e.g., through complementary threading of the pin holes 409 and fastened pins, such as example fastened pin 507).

Figure 6:
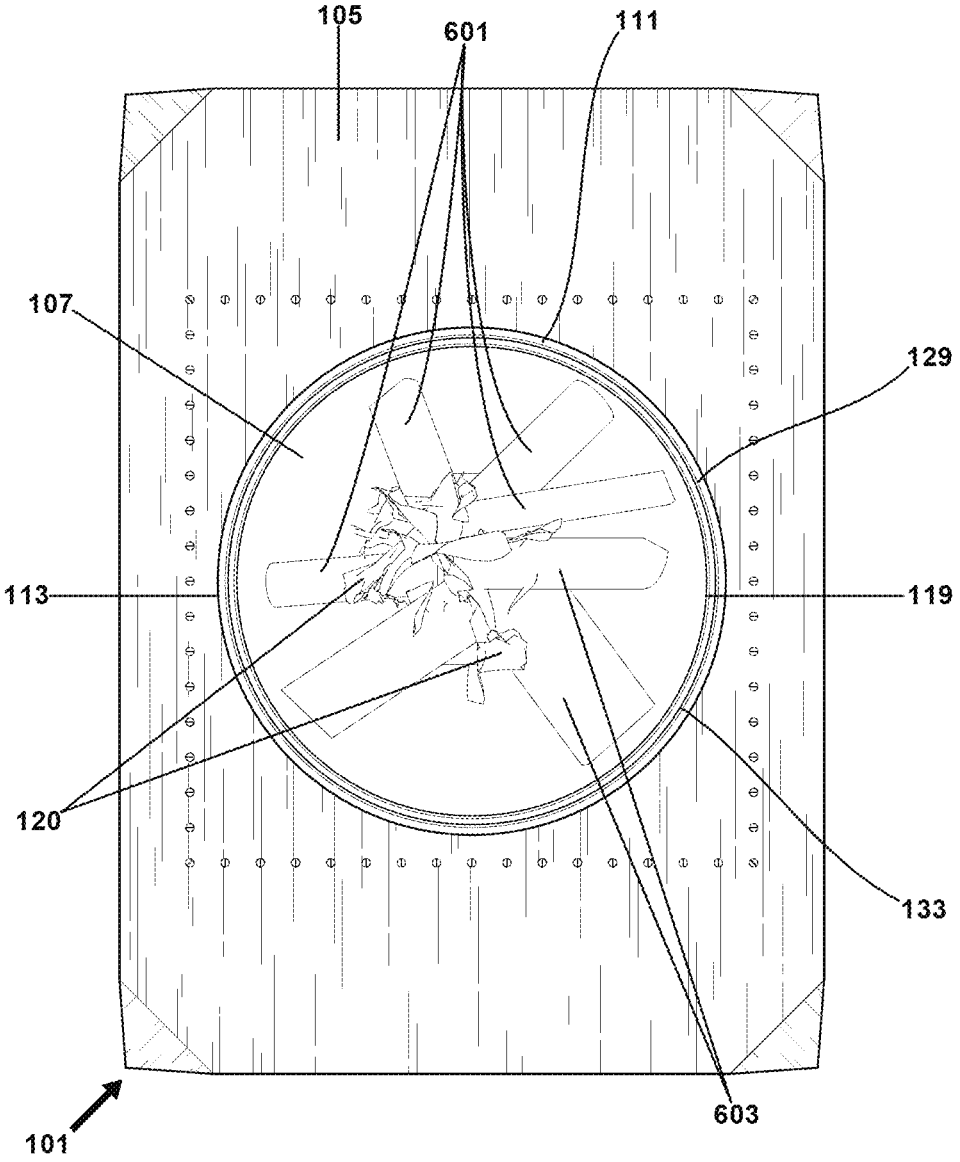
FIG. 6 is a top view drawing of the example fire-containing table set forth above, in FIGS. 1, 2 and 5, with the heat-proof cover removed, and no longer covering, the cut-out in the table top and fire container of the fire-containing table in accordance with some embodiments of the present invention.

FIG. 6 is a top view drawing of the example fire-containing table 101 set forth above, in FIGS. 1, 2 and 5, now with the heat-proof cover removed, and no longer covering, cut-out 113 and fire container 107 of the fire-containing table 101, in accordance with some embodiments of the present invention. Most of the same components and aspects of fire-containing table 101 that were visible in FIG. 5, above, are also visible from the viewing angle of the present figure. And, from the unique perspective of the figure, and with the heat-proof cover now removed, upper edge 119 of fire container 107 (and height-adjustable fire shield 129) can now be clearly seen, as can horizontal gap 111, providing a thermal break between the table top 105 and the fire container 107. As discussed above, the height-adjustable fire shield surrounding the fire container generally forms a ring structure 133, visible rising from the table top 105 when the heat-proof cover is removed (e.g., being spring-load, in some embodiments), although the raised position is not clearly distinguishable from the direct top-down view of the present figure.

Also, with the heat-proof cover removed, and cut-out 113 exposed, flames can be seen, such as example flames 120, now shown rising out of, and above the fire-containing table 101, as well as permitting the fire to breathe and expel gases upward. A suitable fuel 601 for building an outdoor fire, such as logs and/or sticks of wood 603, can also now be seen, and tended by a user, through cut-out 113.

Figure 7:
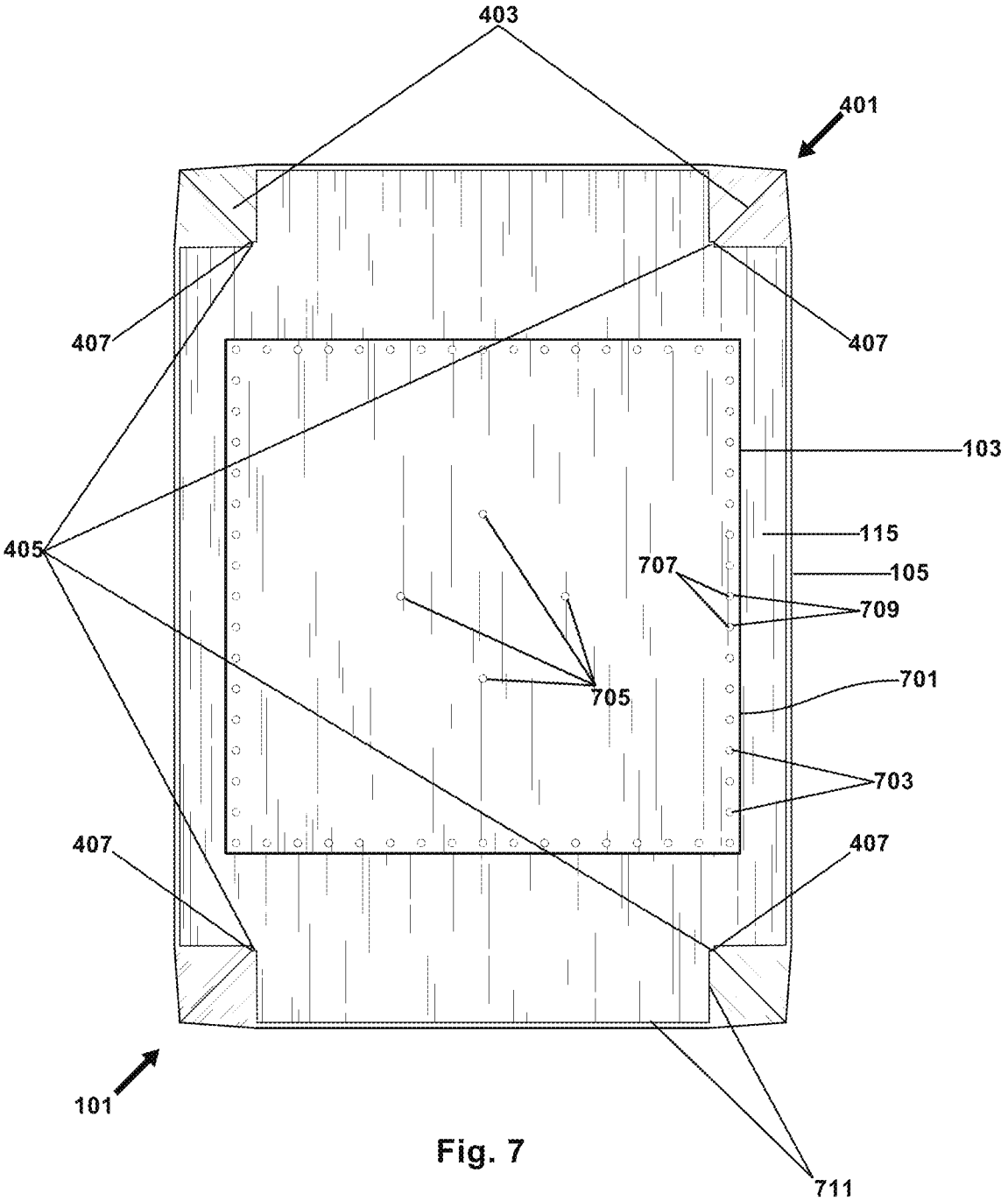
FIG. 7 is a bottom view drawing of the example fire-containing table set forth above, in FIGS. 1, 2, 5 and 6, in accordance with some embodiments of the present invention.

FIG. 7 is a bottom view drawing of the example fire-containing table 101 set forth above, in FIGS. 1, 2, 5 and 6, in accordance with some embodiments of the present invention. From the bottom view, several of the same components of fire-containing table 101 may be seen, albeit from a new viewing angle wherein new aspects are revealed.

For example, main frame component 401, legs 403, minimized footprint 405, downward-facing points 407 of the legs 403, and underside 115 of table top 105, can all be seen from underneath the table, in the bottom view of the figure.

Other new aspects of fire-containing table 101 are now also revealed from the unique perspective of the figure. For example, a bottom panel 701 can now be seen, fastened to the base of fire-holding platform 103. In some embodiments, bottom panel 701 may be, or may form a part of, fire-holding platform 103. In some embodiments, bottom panel 701 is variably detachable and attachable to base of fire-holding platform 103, with removable panel fasteners, such as the example removable fasteners 703. But, in some embodiments, fire-holding platform 103 is fastened to the remainder of fire-containing table 103 with such removable fasteners. And, in some embodiments, such removable fasteners may be the lower portions of platform-suspending pins 109, as discussed above. In some such embodiments, such removable fasteners may include lower, male threading, whilst bottom panel 701 and/or fire-holding platform 103 include lower pin holes, such as the examples shown as lower pin holes 705, which may comprise female threading, in some such embodiments. However, in various embodiments, any other known type of connector and/or fastener may be used to so join fire-holding platform 103 and/or bottom panel 701, in various additional and/or alternative embodiments. In some embodiments, fire-holding platform 103 and/or bottom panel 701 may serve as an ash clean-out, which collects, holds and then releases ashes (when variably removed, as discussed above).

In some embodiments, which will be discussed in greater detail below, a raised, intermediate fire base, not visible in the present figure, but located above bottom panel 701, is included as part of fire-holding platform 103. An example of such a raised, intermediate fire base is shown as example fire base 1007. In some such embodiments, such an intermediate fire base may be suspended above bottom panel 701 by heat-proof and/or insulating spacers, such as the example spacers 707, which, in some such embodiments, are fastened to bottom panel 701. In some such embodiments, heat-proof and/or insulating spacers are in the form of threaded rods, dowels, gratings, bars and/or pins or any other suitable form of spacer known in the art, and may be fastened to spacer pin holes, such as example spacer pin holes 709, in some such embodiments. As will be discussed in greater detail below, in some embodiments, such spacers aid in creating an additional vertical insulation layer and/or air gap, between fire base 1007 and bottom panel 701.

It should also be noted that, in some embodiments, all or part of main frame component 401 may be formed, at least in part, from one or more sheets of material, such as sheet metal or other sheets of material, as shown by exposed edges 711 of such a sheet material. However, the example of a sheet material construction method is only one of virtually innumerable construction method and style embodiments falling within the scope of the invention. For example, in some embodiments, all or part of frame component 401 may be formed, at least in part, from wood and wood working and/or wood-turning, in some embodiments. As another example, in some embodiments, all or part of frame component 401 may be formed, at least in part, from injection molding, in some embodiments. Thus, in some embodiments, exposed edges 711 may not be included in such a fire-containing table. As another example, in some embodiments, legs 403 are constructed from solid three-dimensional shapes, such as any known shapes and materials for table legs and other furniture legs, in various embodiments.

Figure 8:
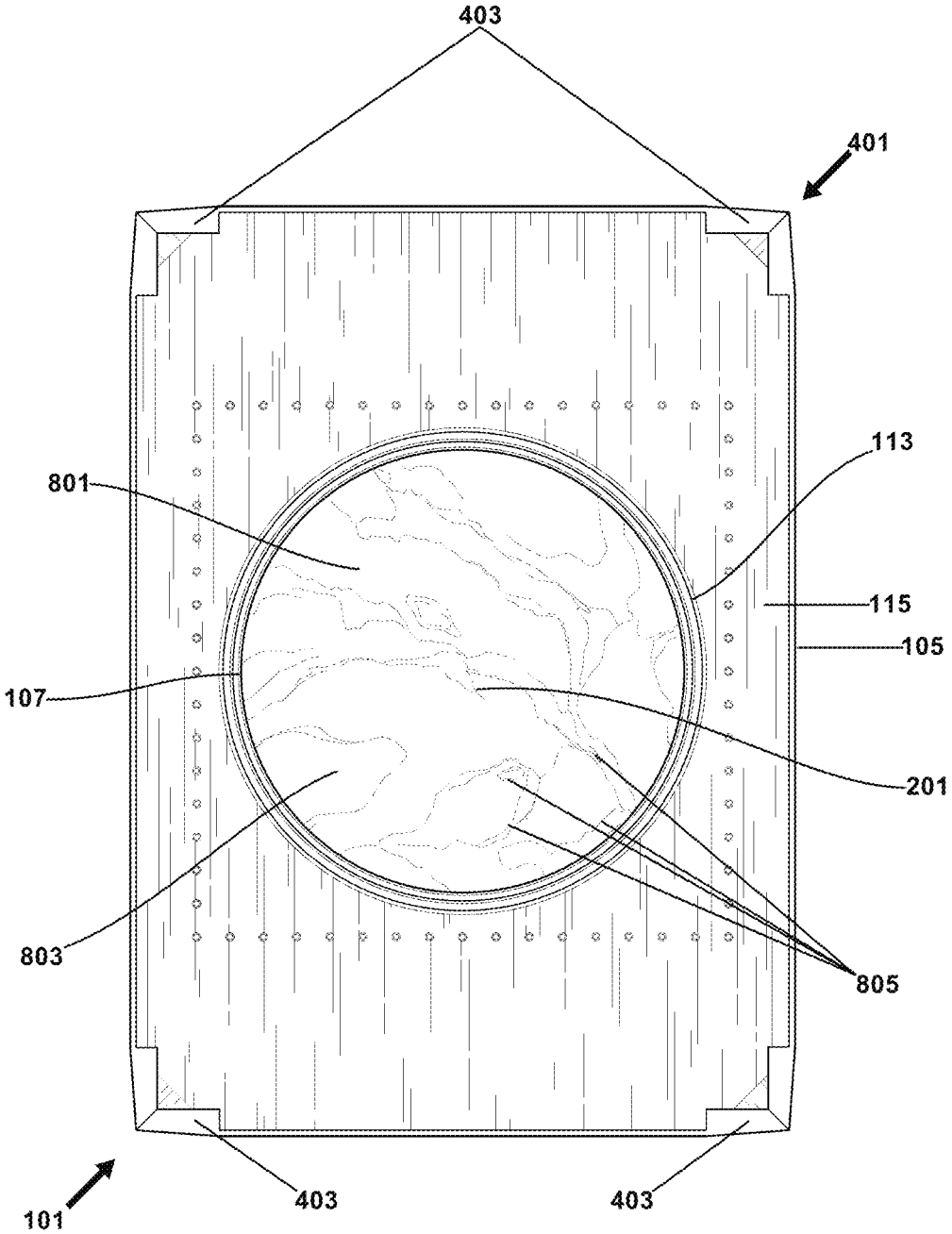
FIG. 8 is a bottom, cross-sectional view drawing of the example fire-containing table set forth above, in FIGS. 1, 2, and 5-7, with a heat-proof cover placed over a cut-out in the table top and fire container of the fire-containing table, in accordance with some embodiments of the present invention.

FIG. 8 is a bottom, cross-sectional view drawing of the example fire-containing table 101 set forth above, in FIGS. 1, 2, and 5-7, with a heat-proof cover 201 placed over a cut-out 113 in the table top 105 and fire container 107 of the fire-containing table 101, in accordance with some embodiments of the present invention. As with FIG. 7, above, from this bottom, cross-sectional view, several of the same components of fire-containing table 101 may now be seen, including the main frame component 401, legs 403, and underside 115 of table top 105. However, from the cross-sectional view, neither the bottom panel 701, nor the fire-holding platform 103, can now be seen, because they are at a position below the plane of the cross-sectional view.

But several additional elements are now visible from the bottom, cross-sectional view of the figure. For example, a lower surface 801 of the heat-proof cover 201 placed over the cut-out 113 in the table top 105 and fire container 107 of the fire-containing table 101 is now visible. As noted above, heat-proof cover 201 may be constructed from any suitable heat-resistant, heat-proof and/or flame-resistant material known in the art, such as granite, stainless steel, nickel and nickel-based alloys, ceramics, glass, quartz, KEVLAR and/or other flame-resistant aramids. As one example, natural stone 803 may be used, in some embodiments, and, in some such embodiments, a marble pattern 805 may appear on the lower surface 801 (as well as the upper surface 203, not visible in the present figure) of heat-proof cover 201.

Figure 9:
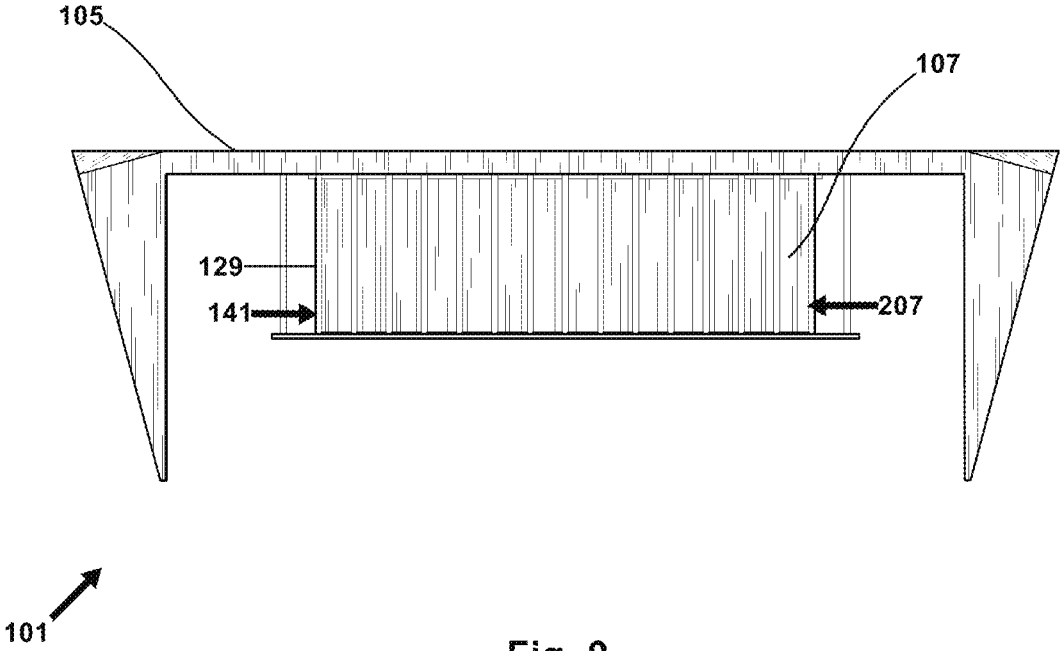
FIG. 9 is a (long) side view drawing of the example fire-containing table set forth above, in FIGS. 1, 2, and 5-8, with a heat-proof cover placed over a cut-out in the table top and fire container of the fire-containing table a height-adjustable fire shield of its fire container in a lowered position, in accordance with some embodiments of the present invention.

FIG. 9 is a (long) side view drawing of the example fire-containing table 101 set forth above, in FIGS. 1, 2, and 5-8, with a heat-proof cover (not visible in the present figure) placed over a cut-out (also not visible in the present figure) in the table top 105 and fire container 107 of the fire-containing table 101 and an height-adjustable fire shield 129 of its fire container 107 in a lowered position 207, in accordance with some embodiments of the present invention. Thus, as discussed above, the air vents 139 (not visible in the present figure) at or about the bottom 141 of the fire container 107 air vents are covered and/or sealed by the height-adjustable fire shield 129, while height-adjustable fire shield 129 is in the lowered position 207.

Figure 10:
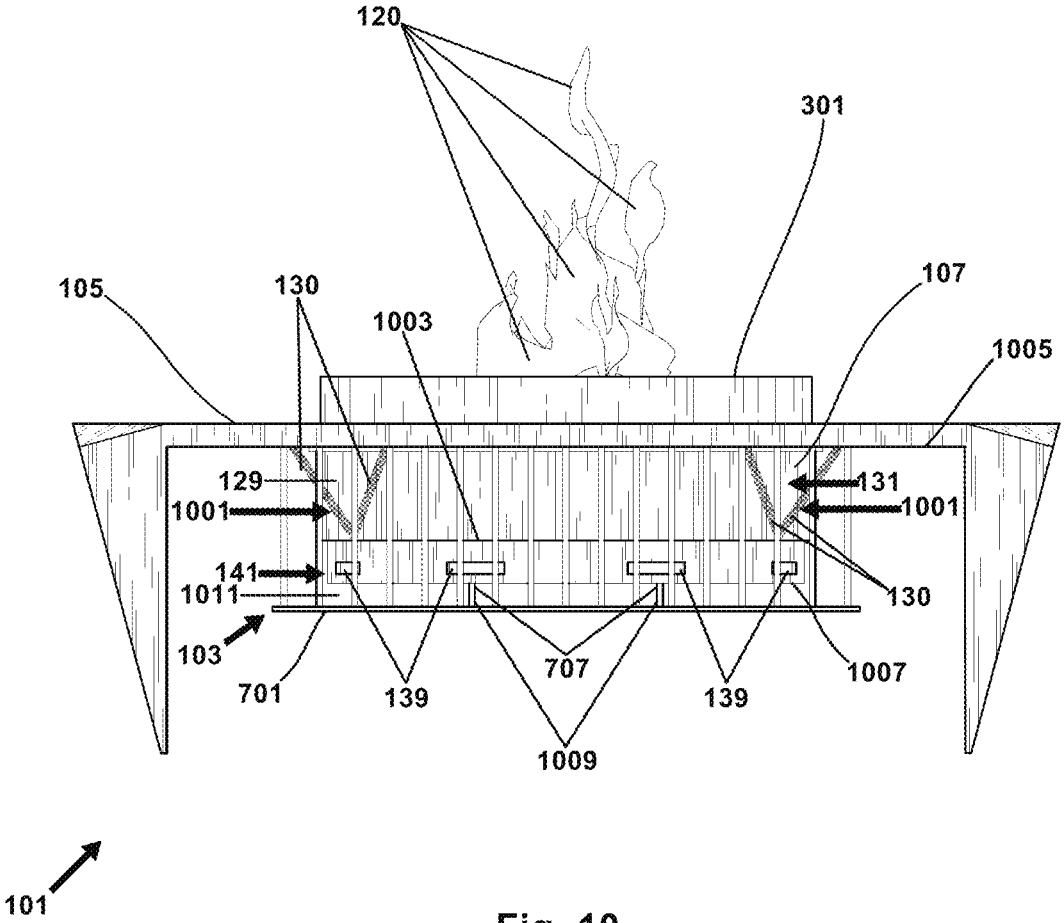
FIG. 10 is another (long) side view drawing of the example fire-containing table set forth above, in FIGS. 1, 2, and 5-9, with no heat-proof cover in place, and with a height-adjustable fire shield of its fire container in a raised position, in accordance with some embodiments of the present invention.

FIG. 10 is another (long) side view drawing of the example fire-containing table 101 set forth above, in FIGS. 1, 2, and 5-9, with no heat-proof cover in place, and with a height-adjustable fire shield 129 of its fire container 107 in a raised position 131, in accordance with some embodiments of the present invention. For example, as discussed above, in some embodiments, a linear actuator and/or force-bias, such as an upward force bias caused by example coil springs 130, has caused height-adjustable fire shield 129 to be raised upward (e.g., upon the removal of the heat-proof cover, the weight of which otherwise overcomes such a force biasing). As a result, the air vents 139 are now visible and open, at or about the bottom 141 of the fire container 107, being no longer sealed by the height-adjustable fire shield 129, while height-adjustable fire shield 129 is in the raised position 131. And airflow is established, allowing a fire to be built and breathe, producing flames 120, through open top 301 of fire container 107. The example coil springs can also be seen to be in a contracted condition 1001, less stretched than when height-adjustable fire shield 129 is in a lowered position, as shown earlier. For example, in some embodiments, each of coil springs 130 may be attached at or about a bottom edge 1003 of height-adjustable fire shield 129, and a bottom side 1005 of table top 105, the distance between which shortens as height-adjustable fire shield 129 is raised, resulting in the contraction of coil springs 130, in some such embodiments, as now shown, in comparison to such a distance when height-adjustable fire shield 129 is in the lowered position.

As discussed above, in some embodiments, a raised, intermediate fire base 1007, located above bottom panel 701, is included as part of fire-holding platform 103. In some such embodiments, and as pictured, such an intermediate fire base may be suspended above bottom panel 701 by heat-proof and/or insulating spacers, such as the example spacers 707, which, in some such embodiments, are fastened to bottom panel 701. In some embodiments, fire base 1007 may be in the form of a flat or concave bottom panel which may include any heat- and/or fire-proof material, suitable for forming a base holding fire and fuel for fire, such as any such suitable metal or ceramic material, in some embodiments. In some embodiments, such heat-proof and/or insulating spacers are in the form of threaded rods (such as example spacer rods 1009), or dowels, gratings, bars and/or pins or any other suitable form of spacer known in the art, and may be fastened to spacer pin holes, in some such embodiments. As will be discussed in greater detail below, in some embodiments, such spacers aid in creating an additional vertical insulation layer and/or air gap 1011, between fire base 1007 and bottom panel 701.

Figure 11:
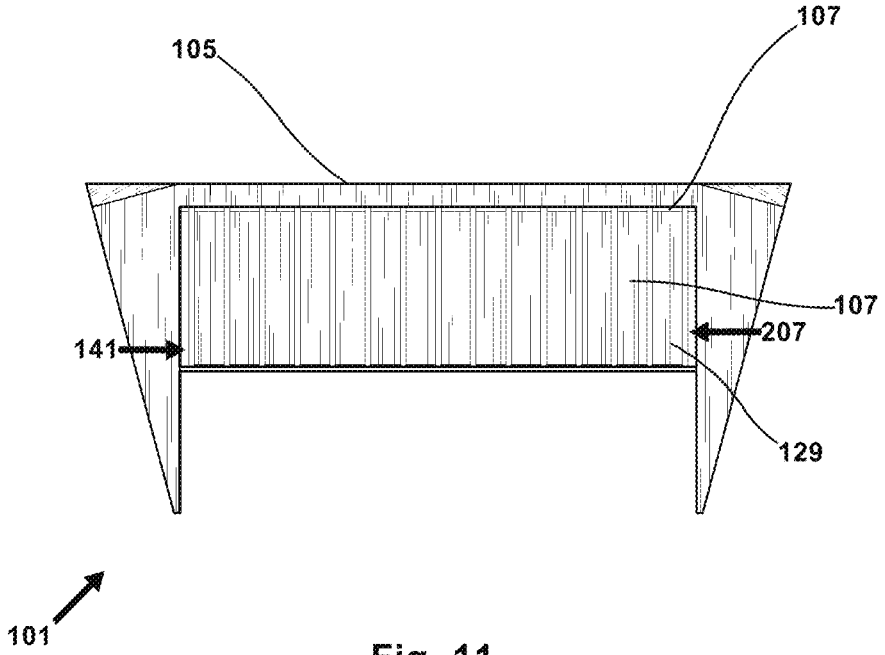
FIG. 11 is a (short) side view drawing of the example fire-containing table set forth above, in FIGS. 1, 2, and 5-10, with a heat-proof cover placed over a cut-out in the table top and fire container of the fire-containing table, and with a height-adjustable fire shield of its fire container in a lowered position, in accordance with some embodiments of the present invention.

FIG. 11 is a (short) side view drawing of the example fire-containing table 101 set forth above, in FIGS. 1, 2 and 5-10, with a heat-proof cover (not visible in the present figure) placed over a cut-out (also not visible in the present figure) in the table top 105 and fire container 107 of the fire-containing table, and with a height-adjustable fire shield surrounding its fire container in a lowered position 207, in accordance with some embodiments of the present invention.

Figure 12:
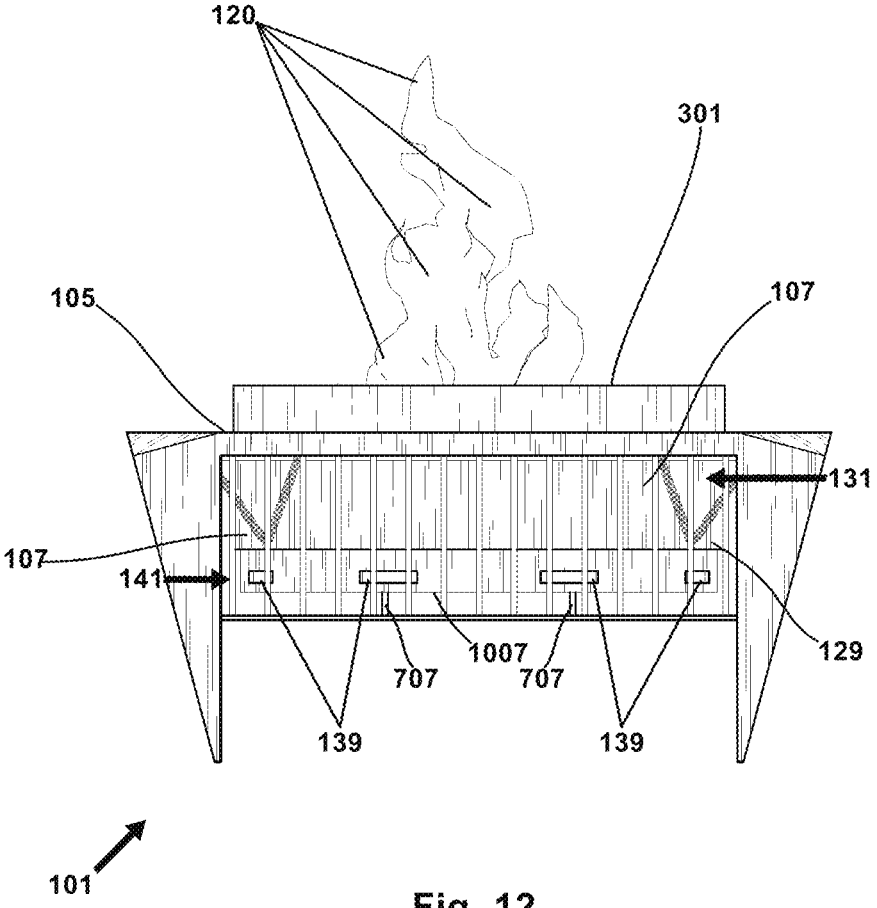
FIG. 12 is another (short) side view drawing of the example fire-containing table set forth above, in FIGS. 1, 2, and 5-11, with no heat-proof cover in place, and with a height-adjustable fire shield of its fire container in a raised position, in accordance with some embodiments of the present invention.

FIG. 12 is another (short) side view drawing of the example fire-containing table 101 set forth above, in FIGS. 1, 2, and 5-11, with no heat-proof cover in place, and with a height-adjustable fire shield 129 of its fire container 107 in a raised position 131, in accordance with some embodiments of the present invention. As a result, the air vents 139 are now visible and open, at or about the bottom 141 of the fire container 107, being no longer sealed by the height-adjustable fire shield 129, while height-adjustable fire shield 129 is in the raised position 131. And airflow is established, allowing a fire to be built and breathe, producing flames 120, through open top 301 of fire container 107.

As discussed above, in some embodiments, a raised, intermediate fire base 1007, located above bottom panel 701, is included as part of the fire-holding platform. In some such embodiments, and as pictured, such an intermediate fire base may be suspended above bottom panel 701 by heat-proof and/or insulating spacers, such as the example spacers 707 discussed above, which, in some such embodiments, are fastened to bottom panel 701.

Figure 13:
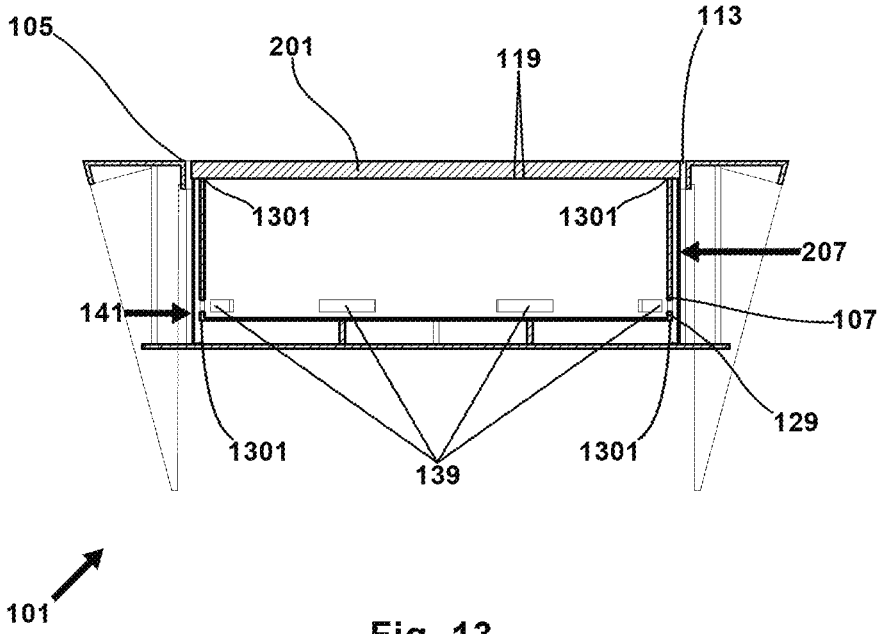
FIG. 13 is a (short) side cross-sectional view drawing of the example fire-containing table set forth above, in FIGS. 1, 2, and 5-12, with a heat-proof cover placed over a cut-out in the table top and fire container of the fire-containing table, and with a height-adjustable fire shield of its fire container in a lowered position, in accordance with some embodiments of the present invention.

FIG. 13 is a (short) side cross-sectional view drawing of the example fire-containing table 101 set forth above, in FIGS. 1, 2, and 5-12, with a heat-proof cover 201 placed over a cut-out 113 in the table top 105 and fire container 107 of the fire-containing table 101, and with a height-adjustable fire shield 129 of its fire container 107 in a lowered position 207, in accordance with some embodiments of the present invention. As discussed above in this application, in the lowered position 207, in some embodiments, the height-adjustable fire shield 201 creates an air-tight seal(s) 1301 with the upper edge 119 of the fire container 107, and, simultaneously, causes the height-adjustable fire shield 129 to descend and tightly meet the fire-holding platform 103, and cover and prevent airflow to the air vents 139, which are only visible in the present figure due to the cross-sectional nature of the view.

Figure 14:
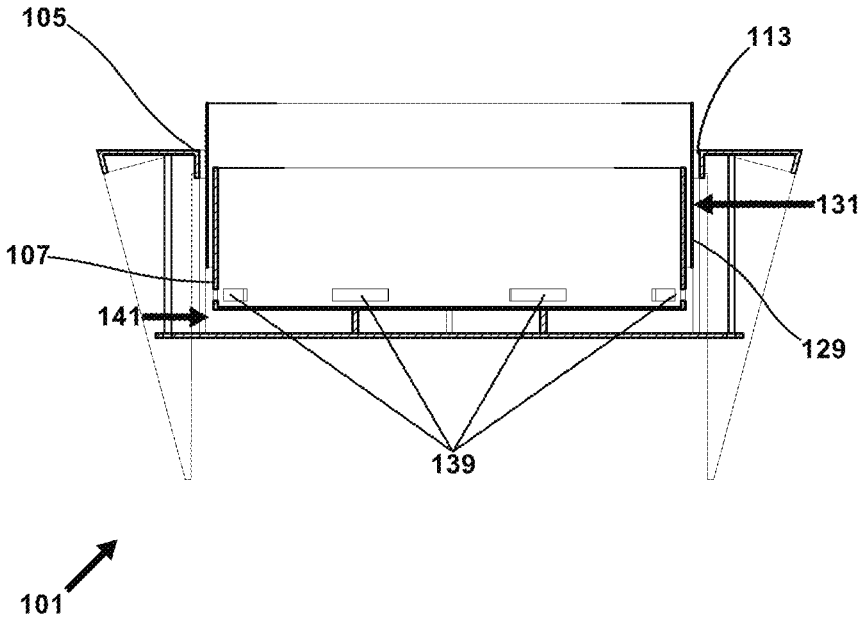
FIG. 14 is another (short) side cross-sectional view drawing of the example fire-containing table set forth above, in FIGS. 1, 2, and 5-13, with no heat-proof cover in place, and with a height-adjustable fire shield of its fire container in a raised position, in accordance with some embodiments of the present invention.

FIG. 14 is another (short) side cross-sectional view drawing of the example fire-containing table 101 set forth above, in FIGS. 1, 2, and 5-13, with no heat-proof cover in place, and with a height-adjustable fire shield 129 of its fire container 107 in a raised position 131, in accordance with some embodiments of the present invention. Air vents 139 are now visible and open, at or about the bottom 141 of the fire container 107.

It should be understood that the above-described components, steps, and number and order of components and steps for the example fire-containing furniture discussed in this application, is only exemplary of certain embodiments set forth in this application, which are not intended to limit the application in any way. In fact, virtually unlimited alternative orders, numbers and instances of the above steps and components, in addition with countless additional and alternative steps, may be used and/or performed, within the scope of the present application and inventions herein, as will be readily apparent to those of skill in the art. Although the example of a metal table has been provided, it should be understood that any suitable alternative form of furniture and components may be used, instead of, or in addition to, such a table, in various embodiments, while carrying out aspects of the present inventions, as will be readily apparent to those of skill in the art.

What is claimed is:

1. An outdoor, recreational fire-containing table, comprising:

a table-top;

a cut-out in said table-top;

a fire-holding platform, suspended vertically, below said table-top and said cut-out, suspended from said table top by a series of periodically-spaced members, creating a first air-gap, vertically, between the table top and the fire-holding platform;

said series of periodically-spaced members each being separated from other, abutting member(s) by a standardized distance, creating a series of horizontal air gaps;

wherein said fire-holding platform is also separated from other components of said outdoor, recreational fire-containing table, and users, by a peripheral air-gap.

2. The outdoor, recreational fire-containing table of claim 1, wherein the periodically-spaced members are fire-resistant or fire-proof.

3. The outdoor, recreational fire-containing table of claim 1, wherein the periodically-spaced members comprise rods, dowels, cables, gratings, bars and/or pins.

4. The outdoor, recreational fire-containing table of claim 1, comprising:

inner, fire-proof wall(s), fastened or otherwise attached or integral with the fire-holding platform.

5. The outdoor, recreational fire-containing table of claim 4, wherein the inner, fire-proof wall(s) comprise(s) one or more ventilating holes, at or about a base of said inner, fire-proof wall(s).

6. The outdoor, recreational fire-containing table of claim 5, comprising:

a circumferential, fire-proof protective ring, comprising an insulator, disposed substantially above a top surface of said table top.

7. The outdoor, recreational fire-containing table of claim 6, wherein the fire-proof protective ring is configured to be raised or lowered, into a raised position or a lowered position, respectively.

8. The outdoor, recreational fire-containing table of claim 7, wherein the fire-proof protective ring is configured to be so raised by force-biasing.

9. The outdoor, recreational fire-containing table of claim 8, wherein the outdoor, recreational fire-containing table comprises a removable and replaceable heat-proof cover; and wherein the removable and replaceable heat-proof cover causes said fire-proof protective ring to be placed in said lowered position when placed over said cut-out.

10. The outdoor, recreational fire-containing table of claim 9, comprising a second air gap, vertically, provided between a bottom panel of said fire-holding platform and an intermediate fire base of said fire-holding platform.

11. The outdoor, recreational fire-containing table of claim 9, wherein so causing said fire-proof protective ring to be placed in said lowered position extinguishes a fire built on said fire-holding platform.

12. The outdoor, recreational fire-containing table of claim 8, comprising a catch, lock and/or switch configured to lock said fire-proof protective ring in the lowered position.

13. The outdoor, recreational fire-containing table of claim 8, comprising a catch, lock and/or switch configured to lock said fire-proof protective ring in the raised position.

14. The outdoor, recreational fire-containing table of claim 1, comprising:

a circumferential, fire-proof protective ring, comprising an insulator, disposed substantially above a top surface of said table top.

15. The outdoor, recreational fire-containing table of claim 14, wherein the fire-proof protective ring is configured to be raised or lowered, into a raised position or a lowered position, respectively.

16. The outdoor, recreational fire-containing table of claim 15, wherein the fire-proof protective ring is configured to be so raised by force-biasing.

17. The outdoor, recreational fire-containing table of claim 16, wherein the outdoor, recreational fire-containing table comprises a removable and replaceable heat-proof cover; and wherein the removable and replaceable heat-proof cover causes said fire-proof protective ring to be placed in said lowered position when placed over said cut-out.

18. The outdoor, recreational fire-containing table of claim 16, comprising a catch, lock and/or switch configured to lock said fire-proof protective ring in the lowered position.

19. The outdoor, recreational fire-containing table of claim 16, comprising a catch, lock and/or switch configured to lock said fire-proof protective ring in the raised position.

20. The outdoor, recreational fire-containing table of claim 1, wherein the outdoor, recreational fire-containing table comprises a removable and replaceable heat-proof cover.

* * * * *